United States Patent [19]

Novak

[11] 3,994,672

[45] Nov. 30, 1976

[54] CANDLE LIGHT TYPE LIQUID FUEL BURNING TABLE LAMP

[76] Inventor: David Michael Novak, 2301 Mountain Ave., San Bernardino, Calif. 92401

[22] Filed: Dec. 12, 1975

[21] Appl. No.: 640,040

[52] U.S. Cl. ..... 431/320; 431/324

[51] Int. Cl.[2] ..... F23D 3/18

[58] Field of Search ..... 431/320, 321, 322, 323, 431/324, 148, 291, 298

[56] References Cited

UNITED STATES PATENTS

| | | | |
|---|---|---|---|
| 189,100 | 4/1877 | Huntington | 431/324 |
| 2,441,242 | 5/1948 | Harkins | 431/323 X |
| 2,784,581 | 3/1957 | Quandt | 431/320 X |

*Primary Examiner*—Edgar W. Geoghegan
*Attorney, Agent, or Firm*—Brown & Martin

[57] ABSTRACT

A fuel container having an upper cylindrical neck in which is inserted a stopper. A tube projects through the stopper through which a wick projects providing an upper loop with free ends projecting into fuel in the container. The upper end of the tube is crimped holding the upper looped end at a projected point above the end of the rod. The stopper is made of a material that when contacting a suitable fuel, such as a hydrocarbon or the like, will expand inwardly and outwardly sealing the space between the stopper and the outer cylindrical sides of the upper neck of the container and inwardly against the tube. A cap is provided for fitting against the upper end of the stopper sealing the wick from the atmosphere.

4 Claims, 4 Drawing Figures

CANDLE LIGHT TYPE LIQUID FUEL BURNING TABLE LAMP

BACKGROUND OF THE INVENTION

Lamps are used in places of entertainment, such as cocktail lounges, bars, restaurants, and the like. These lamps generally burn a liquid fuel or a candle. Thus, the lamps are not connected to any electrical cord outlet. Generally, the lamps are constructed of a translucent material, whether or not a candle is used. This candle light lends to the desired intimate feeling within the restaurant, cocktail lounge or the like.

Several types of fuel burning, wick type, lamps have been used. Generally, these wick type lamps use a fuel container that is refillable. However, it has been found that most restaurants, cocktail lounges, bars and similar type facilities do not favor the filling of fuel and the like into such wick burning lamps. Rather, these facilities would prefer a throw-away type lamp.

The problem with throw-away type lamps is that the fuel must be inserted at the time of manufacture and sale and so contained until time for use. This requires the use of particular types of wicks and sealing for the fuel container so that leaks and evaporation of the fuel are prevented.

It is therefore advantageous to have a simple, easy to construct, easy to operate and insert fuel into, wick type lamp that provides a simulated type candle light.

SUMMARY OF THE INVENTION

In a preferred embodiment of this invention, a fuel container has a generally cylindrical shape. This container may be inserted into a cylindrical translucent lamp structure or may form the bottom structural part thereof. The container has an upwardly projecting cylindrical neck in which a stopper is positioned. The stopper has a hole therethrough for passing a tube. The wick projects in a loop through the tube with the loop projecting out the upper end thereof and the lower free ends of the wick being in the fuel in the container volume. The upper end of the tube is crimped between the two wick strands, providing an upper looped wick projection at the end of the tube. A nonburnable washer fits around the tube and rests on the upper surface of the stopper covering the entire upper surface. This prevents ignition of the stopper from any combustion of the gases at the upper end of the looped wick.

The stopper is made of a suitable material, such as Butyl rubber, that reacts with the hydrocarbon fuel to expand inwardly and outwardly against the tube and inner surface of the cylindrical portion of the container, thus sealing liquid fuel passage therethrough. A cylindrical cap fits over the end of the wick, tube and stopper, forming a seal therebetween. Thus, the fuel in the container and the wick are sealed. Upon removal of the cylindrical cap, the wick may then be ignited. The entire lamp unit can be thrown away or the inner container may be removed and thrown away as desired.

Other objects and many advantages of this invention will become more apparent upon a reading of the following detailed description and an examination of the drawing, wherein like reference numerals designate like parts throughout and in which.

Figure 1:
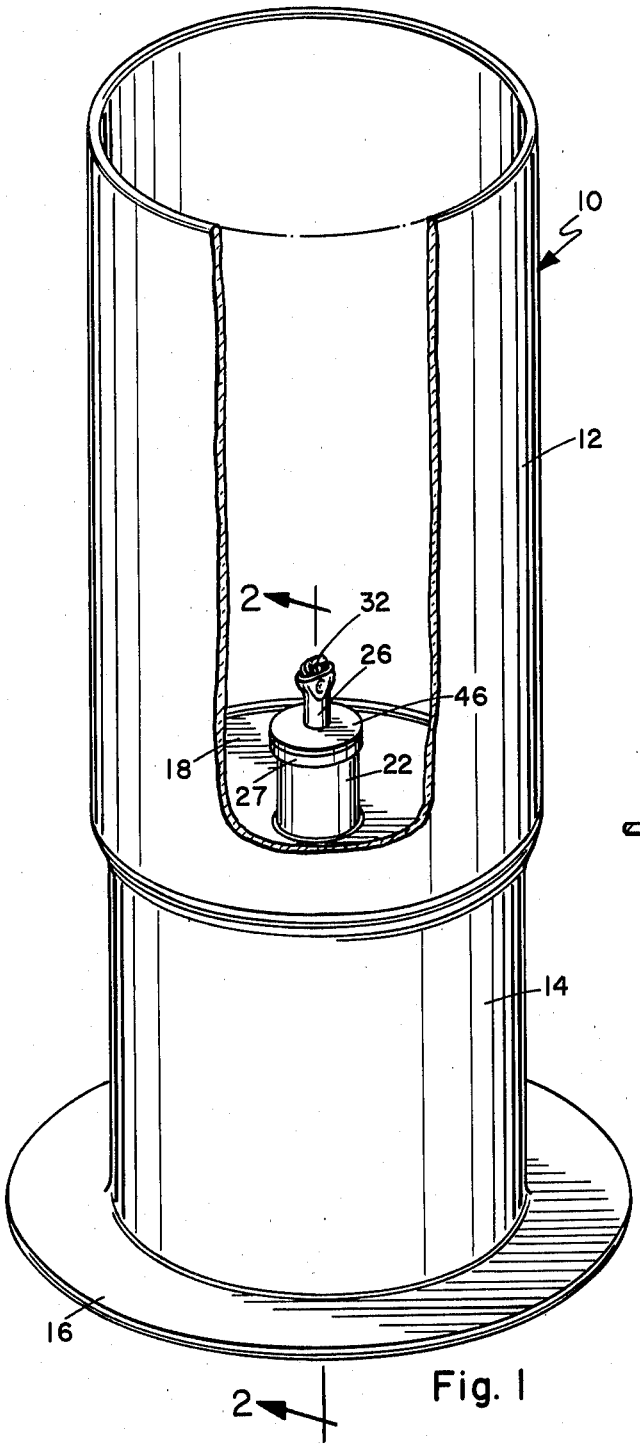
FIG. 1 is a side perspective view with partially cut away section illustrating a preferred embodiment of the invention.
Figure 2:
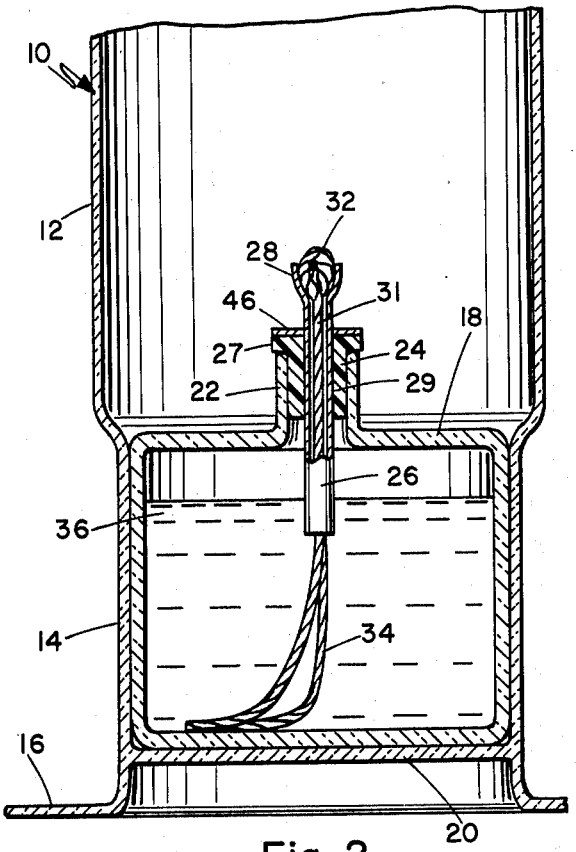
FIG. 2 is a sectional view taken along line 2—2 of FIG. 1.

Referring now to FIGS. 1 and 2 of the drawing, the candle light type liquid fuel burning table lamp 10 has an upper cylindrical member 12 that may be made of clear or translucent material, but preferably translucent. The lamp 10 has a lower portion 14 of reduced diameter and then extends into a ring shaped base member 16. The lower portion of the lamp has a bottom wall 20 on which rests a cylindrical container 18. The container may be made of any suitable material and preferably is made of glass as is the preferable construction for the outer lamp portions 12, 14 and 16.

The container 18 has an upper cylindrical neck 22 in which is positioned a stopper 24 having an enlarged flange portion 27 with a lower surface that fits on the upper edge of the neck 22.

Figure 4:
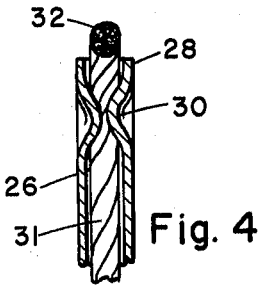
FIG. 4 is an enlarged sectional view taken along line 4—4 of FIG. 3.

The stopper 24 has a hole 29 therethrough, through which a tube 26 passes. A wick 31 projects through the tube 26 and has a looped end 32 projecting from the upper end 28 of the tube. The tube is crimped at 30 between two strands of the looped wick end, providing the upwardly projected and separated looped portion 32 of the wick. The lower free ends 34 of the wick 31 extend down into the fuel 36 in the container 18. Thus, a cheap and inexpensive crimp provides the separated spacing of the wick strands forming the aforesaid loop, as in FIG. 4.

In operation, the fuel such as a hydrocarbon 36, is swirled around in the container 18 and thus contacts the stopper 24. The stopper 24 is made of a material that expands when contacted by a hydrocarbon fuel. Thus, the stopper expands outwardly and inwardly forming a seal between the upper neck 22 and the tube 26. Thus, the fuel cannot leak out of the container 18 and the stopper 24 is fixedly positioned in the opening. This can be quickly and easily accomplished.

A fire impervious washer 45 fits around the tube 26 and covers the upper surface of the flanged portion 27 of the stopper. This protects the stopper from combustion from any flames that may move down the upper end 28 of the tube. A cap 38 fits over the wick, tube, and stopper end flange 27 and forms a seal therebetween, preventing the loss of fuel during transit of the lamp.

Figure 3:
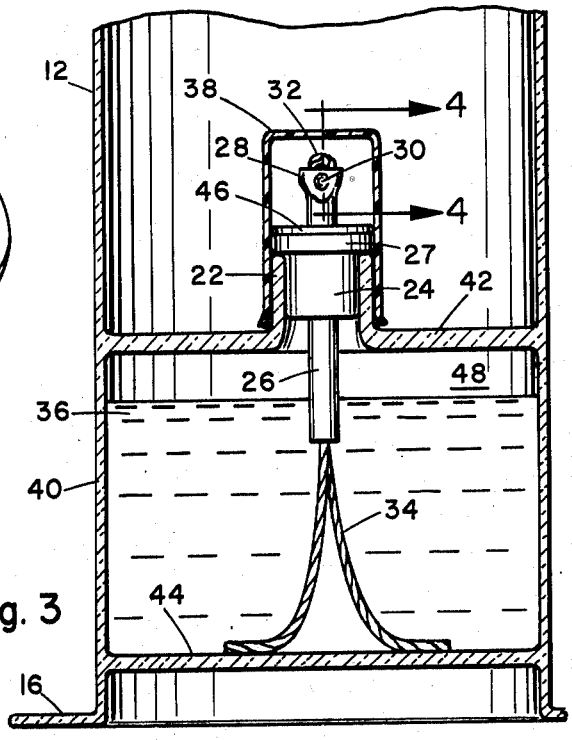
FIG. 3 is a modified embodiment of that illustrated in FIG. 2.

The container 18 may be held in the lower lamp portion 14 in any suitable manner, either permanently fixed or removable for replacement. Alternatively, the fuel container may be incorporated directly into the lamp, as in FIG. 3.

In this configuration, the lower side wall 40 is the same diameter as the upper cylinder 12 and has internal upper and lower walls 42 and 44, respectively, which encloses a fuel container 48. Neck 22 extends from upper wall 42, the stopper and wick assembly being as described above. After the fuel 36 is used up the entire lamp would be discarded, the cost being low compared to the cost of labor necessary for proper refilling of such a lamp.

It may be understood that when the gases at the wick 32 are illuminated, they burn in the known manner and provide a light that through the translucent cylinder 12 apears to be a candle light.

Having described my invention, I now claim:

1. A candle light type liquid fuel burning table lamp comprising:

a container for holding liquid fuel, said container having a cylindrical upper neck, a cylindrical stopper in said cylindrical neck, said stopper having a centered hole therethrough, a tube fixed through said hole, looped wick means projecting from said container through said tube, the upper end of said tube being above the upper surface of the stopper and being crimped at its upper end between two strands of looped wick projecting from the end of the tube, separating said strands and forming an outwardly projecting end wick loop, a fire impervious washer fitting around said tube and resting on and covering the upper surface of said stopper, and said stopper being of a material that is expandable in contact with the fuel to expand outwardly against the cylindrical neck and inwardly against said tube for sealing against liquid fuel passage.

2. A candle light type liquid fuel burning table lamp as claimed in claim 1 including:

a cap for fitting over said washer, stopper and upper cylindrical neck and forming a seal around the outer surface of said stopper.

3. A candle light type liquid fuel burning table lamp as claimed in claim 1 and including:

a cylindrical lamp enclosure that is at least partially translucent to light, and said container being cylindrical and being held in the lower portion of said enclosure.

4. A candle light type liquid fuel burning table lamp as claimed in claim 1 and including:

a cylindrical lamp enclosure that is at least partially translucent to light, said container comprising the lower portion of said enclosure.

* * * * *